US005456522A

United States Patent [19]

Beach

[11] Patent Number: 5,456,522

[45] Date of Patent: Oct. 10, 1995

[54] CONCAVE CUTTER BIT

[75] Inventor: Wayne H. Beach, Roaring Spring, Pa.

[73] Assignee: Kennametal Inc., Latrobe, Pa.

[21] Appl. No.: 323,481

[22] Filed: Oct. 14, 1991

[51] Int. Cl.[6] ..... E21C 35/183

[52] U.S. Cl. ..... 299/113; 299/106

[58] Field of Search ..... 299/79, 86, 91, 299/88; 175/402, 403, 435, 427, 412, 375; 37/452, 453

[56] References Cited

U.S. PATENT DOCUMENTS

| | | | |
|---|---|---|---|
| 3,519,309 | 7/1970 | Engle et al. | 299/86 |
| 3,752,515 | 8/1973 | Oaks et al. | 403/344 |
| 3,791,465 | 2/1974 | Metge | 175/373 |
| 4,222,446 | 9/1980 | Vasek | 175/427 |
| 5,007,685 | 4/1991 | Beach et al. | 299/91 |
| 5,078,219 | 1/1992 | Morrell et al. | 175/427 |
| 5,135,035 | 8/1992 | Mills | 144/241 |
| 5,333,938 | 8/1994 | Gale | 299/86 |

FOREIGN PATENT DOCUMENTS

| | | | |
|---|---|---|---|
| 1029841 | 7/1983 | U.S.S.R. . | |
| 1284539 | 8/1972 | United Kingdom | 299/91 |

OTHER PUBLICATIONS

Properties and Proved Uses of Kennametal hard carbide alloys, p. 43, Copyright 1972 Brazing Manual, American Welding Society, 1963 pp. 232–236.

*Primary Examiner*—David J. Bagnell
*Attorney, Agent, or Firm*—John J. Prizzi

[57] ABSTRACT

A concave cutter bit which has a bit body that contains a concavity in the axially forward end thereof. A plurality of cutter inserts are brazed to the bit body at the periphery of the open end of the concavity. The cutter inserts are spaced-apart in such a fashion so that a gap exists between adjacent cutter inserts that is of sufficient size to prevent the formation of a continuous braze joint between any adjacent cutter inserts.

20 Claims, 2 Drawing Sheets

CONCAVE CUTTER BIT

BACKGROUND OF THE INVENTION

The invention pertains to a cutter bit for use in conjunction with excavation equipment. More particularly, the invention pertains to a rotatable concave cutter bit for use in conjunction with excavation equipment such as, for example, a longwall shearer, a continuous mining machine, a trencher, a road milling machine, an auger and a saw.

Some conventional cutter bits used for excavation equipment utilize a single cutting element at the forward end thereof. In this particular application, it is only this single cutting element that forms the effective cutting element of the cutter bit that impinges upon and cuts or fractures the substrate such as, for example, earth strata. The balance of the forward end of the cutter bit pushes fractured or cut material out of the path of the cutter bit.

Another style of cutter bit for use with excavation equipment is a concave cutter bit. The typical concave cutter bit has an enlarged diameter portion, which contains a concavity, at the forward end thereof. A cutter element of hard material such as, for example, cemented tungsten carbide, surrounds the outer periphery of the concavity so that the cutter element presents a generally circular or ring-like shape. One example of a concave cutter bit is illustrated by U.S. Pat. No. 5,078,219 to Morrell et al. Another example of such a cutter bit is shown by U.S. Pat. No. 5,333,938 to Gale.

The cutter element can take the form of a single piece ring such as is shown by the Morrell et al. patent. Typically, the cutter element is made out of cobalt-cemented tungsten carbide and the bit body is made from steel. The cutter element is secured to the steel bit body by brazing so that, at a minimum, there is a braze joint between the bottom surface of the carbide cutter element and the surface of the cutter bit body.

Carbides such as cobalt-cemented tungsten carbide have coefficients of thermal expansion that are approximately one-half to one-third that of steel. Because of this difference in thermal expansion, the steel bit body and the cemented tungsten carbide cutter element contract at different rates upon cooling after the brazing operation. This difference in contraction creates cracks in the braze joint and/or brazing stresses at the braze joint.

The existence of cracks in the braze joint can cause the bit to fail quality control inspection and be discarded as scrap. The existence of cracks or brazing stresses can lead to the early failure of the concave cutter bit during operation. It is apparent that the failure of the cutter bit to either pass quality control examination or function well in the field is undesirable.

The cutter elements can also take the form of a plurality of segments positioned adjacent to one another in an end-to-end relationship so as to form a complete ring. It has been found, however, that the presence of cracks and braze stresses are not reduced by the use of a plurality of cutter insert segments in comparison to a cutter bit with a single piece ring-shaped cutter element. For those cutter bits where the cutter element comprises a plurality of segments, each segment is positioned so that its end surfaces are near, but slightly spaced apart from, the corresponding end surface of the adjacent cutter element. In the past, the distance of the spacing has been about 0.020 inches.

During the brazing operation, braze alloy flows between the opposite ends of adjacent cutter element segments to form a continuous volume of braze alloy between the opposite end surfaces of the adjacent cutter element segments. A volume of braze alloy also exists between each one of the cemented tungsten carbide cutter element segments and the steel cutter bit body.

Upon initial cooling after the brazing operation, the braze joint between the opposite end surfaces of adjacent cutter element segments solidifies as does the braze joint between the cutter element segments and the cutter bit body. At this point in time, however, the steel cutter bit body and the cutter element segments must still cool to room temperature.

As the cutter bit and cutter element segments continue to cool and contract, the difference in the rate of contraction between the steel bit body and the cutter element segments, which now behave as if they were one piece, creates braze stresses or cracks in a fashion like that for the single piece cutter element.

It thus becomes apparent that the problems associated with brazing stresses and braze joint cracks exist for concave cutter bits having either a single piece ring-shaped cutter element or a cutter element comprising a plurality of segments where a continuous braze joint forms between the opposing end surfaces of the adjacent segments.

Thus, it would be desirable to provide an improved concave cutter bit that does not experience, or at least has reduced, brazing stresses and brazing cracks. As a consequence, such a concave cutter bit would experience less quality control rejections, as well as fewer premature failures so as to provide a longer, more consistent useful life.

SUMMARY OF THE INVENTION

It is an object of the invention to provide for an improved cutter bit.

It is still another object of the invention to provide for an improved concave cutter bit for use in conjunction with excavation equipment.

It is a further object of the invention to provide for an improved concave cutter bit for use in conjunction with excavation equipment such as, for example, a longwall shearer, a continuous mining machine, a trencher, an auger, a road milling machine, and a saw wherein the cutter bit has reduced or no brazing stresses.

In one form thereof, the invention is a rotatable cutter bit comprising a bit body which has opposite forward and rearward ends and an open-ended concavity in the forward end thereof. A plurality of cutter inserts are secured by brazing to the bit body at the periphery of the open end of the concavity. Adjacent cutter inserts are spaced-apart so that a gap therebetween is sufficient in size to prevent the formation of a continuous braze joint between the adjacent cutter inserts.

In another form thereof, the invention is a cutter bit-block assembly comprising a block which contains a bore therein and a cutter bit with a bit body. The bit body has opposite axially forward and rearward ends wherein the axially forward end of the bit body contains therein a concavity with an open end and a peripheral surface surrounds the open end. The bit body has a retainer that engages the bore of the block so as to retain the cutter bit to the block. A plurality of cutter inserts are secured to the peripheral surface in a spaced-apart fashion so that a gap exists between each adjacent one of the cutter inserts wherein each one of the gaps is sufficient in size to prevent the formation of a continuous braze joint between the adjacent cutter inserts.

In still another form thereof, the invention is a cutter bit for impinging a substrate wherein the cutter bit comprises an elongate bit body having an impingement end. The impingement end has a peripheral region with a plurality of cutter inserts connected to the bit body at the peripheral region thereof. The cutter inserts are spaced-apart so as to define a spatial gap between any two adjacent cutter inserts.

BRIEF DESCRIPTION OF THE DRAWINGS

The following is a brief description of the drawings which form a part of this patent application.

DETAILED DESCRIPTION OF SPECIFIC EMBODIMENTS

Figure 1:
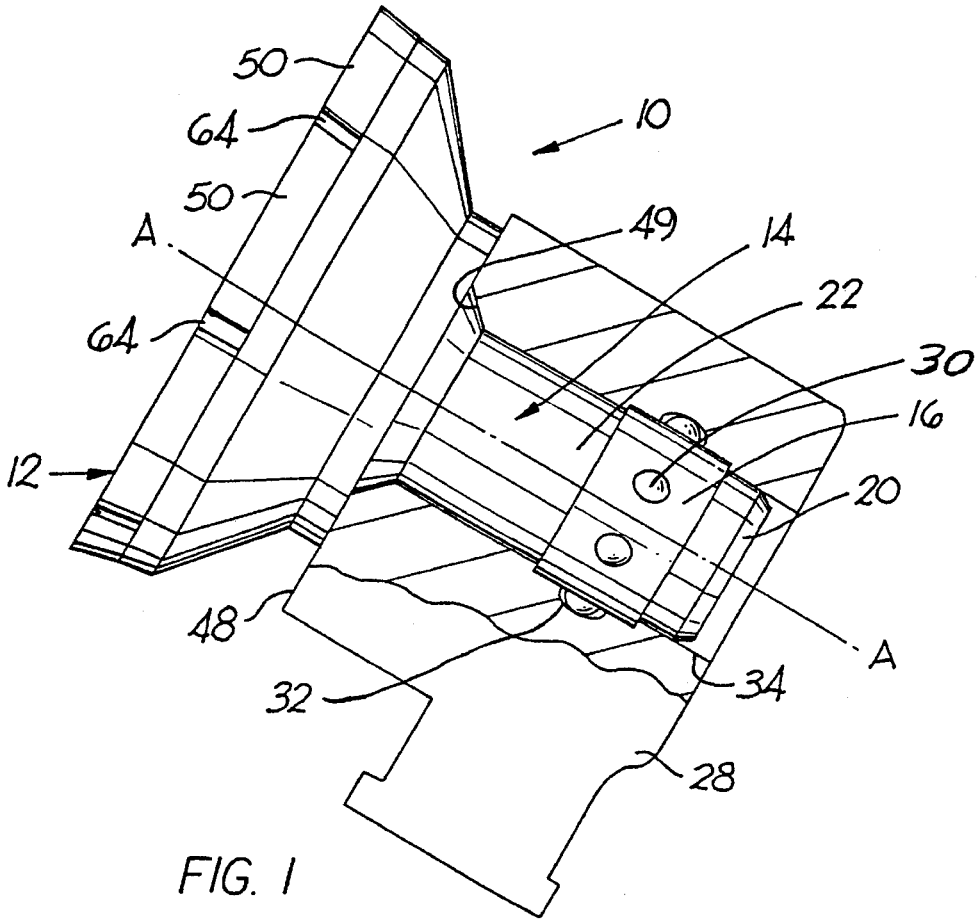
FIG. 1 is a side view of a specific embodiment of the concave cutter bit of the invention with the cutter bit attached to a block wherein the block is shown in partial cross-section so as to illustrate the connection between the cutter bit and the block.
Figure 2:
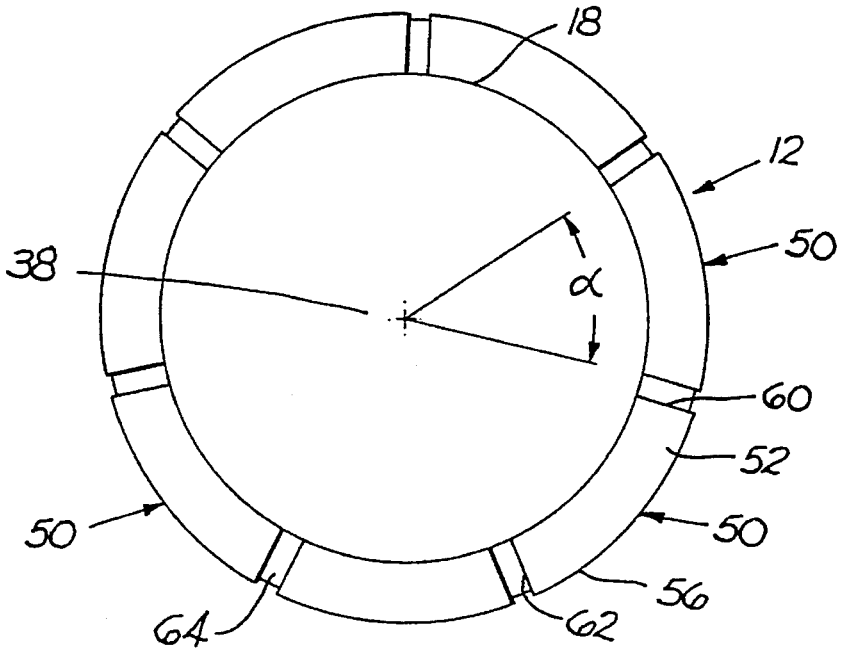
FIG. 2 is an end view of the cutter bit shown in FIG. 1.

Referring to the drawings, FIGS. 1 through 4 show one specific embodiment of the concave cutter bit of the invention which carries the general designation 10. Concave cutter bit 10 comprises three principal parts; namely, a cutter element, generally designated as 12, a bit body, generally designated as 14, and a retainer clip 16.

The bit body 14 is generally symmetric about a central longitudinal axis A—A shown in FIG. 1. Bit body 14 has an axially forward end 18 and an axially rearward end 20. As will become apparent from the description herein, the forward end 18 of the cutter bit 10 impinges upon the substrate so as to cut and fracture the substrate. The forward end 18 could therefore be considered the impingement end of the cutter bit 10. A preferably cylindrical integral shank 22 is near the rearward end 20 of the bit body 14. A preferably frustoconically shaped integral head 24 is near the forward end 18 of the bit body 14.

The cylindrical shank 22 preferably has a annular groove 26 therein which carries the retainer clip 16. The drawings illustrate the preferred retainer clip 16, which is a so-called dimple clip. U.S. Pat. No. 3,519,309 to Engle et al. and U.S. Pat. No. 3,752,515 to Oaks et al. each describe such a retainer clip.

It should, however, be appreciated that other retainer structures are suitable for use with the present invention. For example, a so-called long retainer, which comprises a compressible elongate cylindrical member that is carried in a channel near the rear of the bit body, may be used with the present invention. U.S. Pat. No. 4,886,710 to Greenfield for a MINING/CONSTRUCTION TOOL BIT HAVING BIT BODY FABRICATED FROM MN-B STEEL ALLOY COMPOSITION, and U.S. Pat. No. 4,911,504 to Stiffler et al. for a CUTTER BIT AND TIP each illustrate the long retainer as applied to a point attack style of tool.

In practice, one drives the shank of the cutter bit into the bore of a holder, such as a block 28, so that the radially outwardly projecting bumps 30 of the preferred retainer clip 16 register with an annular interior groove 32 in the cylindrical bore 34 of the block 28. The concave cutter bit 10 is then free to rotate relative to the block 28.

Although the specific embodiment presents a cutter bit 10 that is rotatable relative to the holder or block 28, there is no intention to limit the scope of the invention to a rotatable cutter bit. Applicant contemplates that the present invention encompasses nonrotatable cutter bits, i.e., a cutter bit that does not rotate relative to its holder, as well as rotatable cutter bits. In regard to the non-rotatable cutter bits, the cutter bit may be indexable in the sense that when one cutter element wears out, one may index the cutter bit to another position relative to the holder so as to expose an unworn cutter element for cutting.

The bit body 14 preferably contains a concavity 38 near the axially forward end 18 thereof. The surface of the concavity 38 preferably defines the volume of a right cone. Other geometric shapes besides a right cone are within the scope of the present invention. The opening of the concavity 38 is preferably generally circular in shape and begins at a position radially inwardly from the peripheral edge 40, and near the forward end 18, of the cutter bit body 14.

The bit body 14 has a peripheral region at the periphery of the opening of the concavity 38, which preferably contains an annular channel 42. Channel 42 surrounds the periphery of the opening of the concave portion 38. The channel 42 has a transverse surface 44 and a longitudinal surface 46 which intersect to form an open face style of pocket. The transverse surface 44 is generally perpendicular to the longitudinal axis A—A of the concave cutter bit 10. The longitudinal surface 46 is generally parallel to the longitudinal axis A—A of the concave cutter bit 10.

Even though the open face style of pocket is the preferred way to connect the cutter element 12 to the bit body 14, there is no intention to limit the scope of the invention to the use of a channel or a pocket. Applicant contemplates that the cutter element 12, i.e. the segments comprising the cutter element, can be secured to a flat surface surrounding the periphery of the opening of the concavity by brazing or other means of connection. The segments of the cutter element 12 could also be received in a bore or hole contained in the peripheral region that surrounds the opening of the concavity.

The frusto-conical head 24 preferably includes a cylindrical shoulder 47 which engages the forward face 48 of the block 28 so as to help keep the cutter bit 10 from moving too far into the bore of the block. The portion of the frusto-conical surface that is rearward of the shoulder corresponds to, and during operation engages, the mouth 49 of the bore of the block.

There is no intention to limit the invention to the specific cutter bit body shown by the drawings and described herein. The cutter bit body may take on other forms and geometries such as, for example, the shank of the cutter bit may be square or acylindrical in crosssection so as to be held in a non-rotatable fashion by a corresponding square or acylindrical bore.

Alternatively, the shank of the cutter bit and the bore of the block may be cylindrical, but the cutter bit is still held in the block in an indexable, nonrotatable fashion. One example of this type of arrangement is to modify the rear of the shank of the cutter bit and the rear of the block to use the mechanism shown in U.S. Pat. No. 5,007,685 to Beach et al. for a TRENCHING TOOL ASSEMBLY WITH DUAL INDEXING CAPABILITY, i.e., a serated indexing washer non-rotatably held on the shank and engaged in indentations in the rear of the block.

In the specific embodiment illustrated by the drawings, the cutter element 12 preferably comprises seven separate cutter inserts, each of which carries the general designation 50. Cutter insert 50 is preferably arcuate in shape, and has a preferred included angle "α" of approximately 44° 30'. Cutter insert 50 preferably has a generally flat top surface 52, a generally flat bottom surface 54, a generally arcuate exterior side surface 56, a generally arcuate interior side surface 58 and generally flat opposite end surfaces 60, 62. The surfaces of the cutter insert 50 intersect with adjacent surfaces to form relatively sharp corners. It is preferable that the overall dimensions of the interior side surface 58 is smaller than that of the exterior side surface 56 so that the top surface 52, the bottom surface 54, and the end surfaces 60, 62 taper inwardly as they move toward the interior side surface 58.

In the specific embodiment, the cutter bit 10 carries the cutter inserts 50 in such a fashion so that the end surfaces 60, 62 of each cutter insert 50 do not contact the end surfaces of the adjacent cutter inserts. The spatial gap 64 is of such a distance that a continuous braze joint does not form between the opposing ends of the adjacent cutter inserts 50.

In practice, applicant has found that a spatial gap of about 3/16 th of an inch is satisfactory to prevent the formation of a braze joint between adjacent cutter elements 50. There is no intention, however, to limit the scope of the invention to any specific dimensional gap between the cutter inserts wherein the cutter inserts are positioned about the periphery of the forward end of the cutter bit. The principal feature of the gap is that it should be sufficiently wide so that a continuous braze joint between the cutter inserts does not form and solidify before the solidification of the braze joint between the steel body and the cutter inserts.

Figure 3:
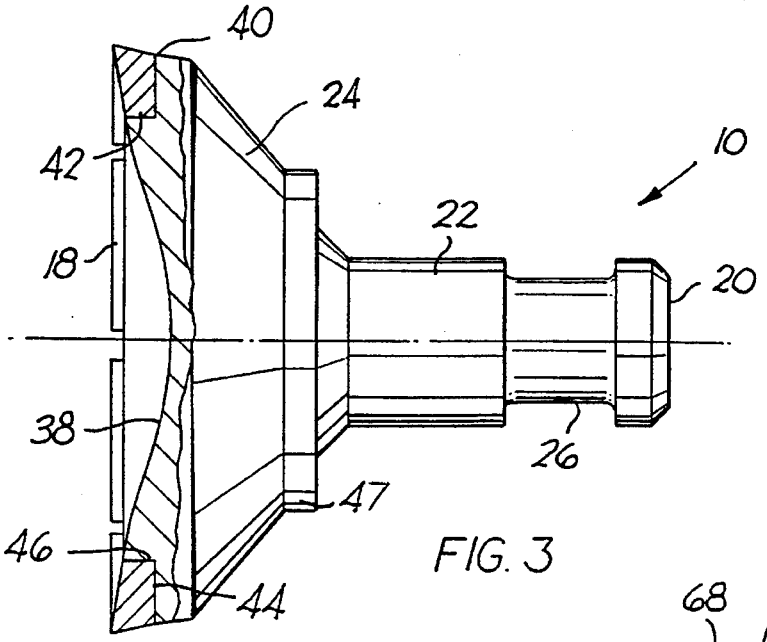
FIG. 3 is a side view of the specific embodiment of FIG. 1 without the retainer clip, and with a portion of the bit body shown in cross-section so as to illustrate the connection between the cutter inserts and the bit body.
Figure 3A:
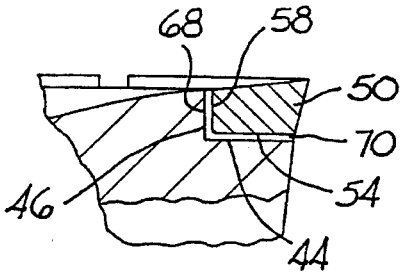
FIG. 3A is an enlarged view of a portion of the cutter bit with a portion shown in cross-section so as to illustrate the braze joints between the cutter insert and the bit body.
Figure 4:
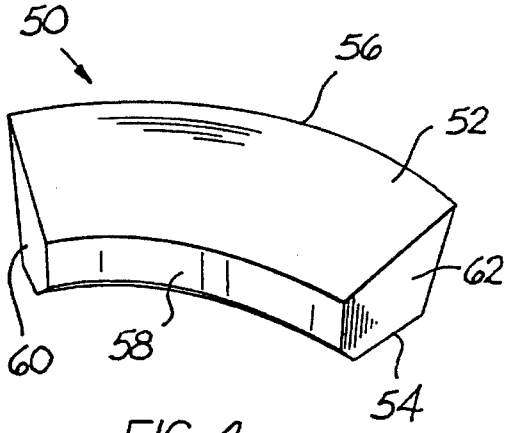
FIG. 4 is a perspective view of the cutter insert of FIG. 1.

Referring to FIG. 3A, a braze joint 68 exists between the interior side surface 58 and the longitudinal surface 46 of the channel 42. A braze joint 70 exists between the bottom surface 54 of each cutter insert 50 and the transverse surface 44 of the channel. Although some braze material may exist between the adjacent end surfaces of adjacent cutter inserts, it is not the intention to form a continuous braze joint, and such a braze joint does not exist, between the opposing end surfaces of adjacent cutter inserts.

The gap 64 between the cutter inserts 50 prevents the formation of a braze joint between adjacent cutter inserts 50. As previously mentioned, the formation of such a braze joint causes the separate cutter inserts 50 to join together thereby creating the same braze stresses and braze cracks as in a single ring-shaped cutter element. The gap 64 also accommodates the difference in the coefficients of thermal expansion between steel and cemented tungsten carbide so as to reduce or eliminate brazing stresses and cracks in the braze joint. The reduction, or elimination, of brazing stresses and braze cracks adds to the overall integrity of the cutter bit.

Figure 5:
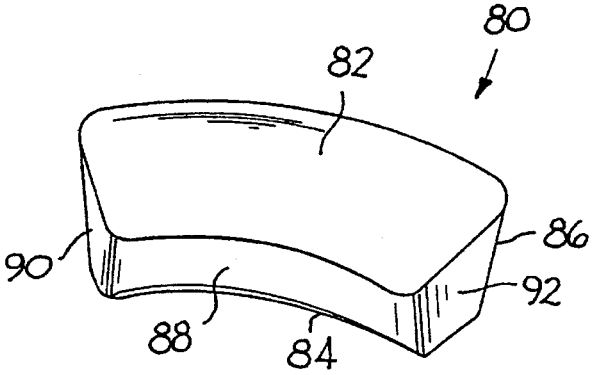
FIG. 5 is a perspective view of a modified cutter insert for use with a concave cutter bit body like that of FIG. 1.

Referring to FIG. 5, there is illustrated an alternate style of cutter insert generally designated as 80. Cutter insert 80 is preferably generally arcuate in shape, and has a preferred included angle like that of cutter insert 50. Cutter insert 80 preferably has a generally flat top surface 82, a generally flat bottom surface 84, a generally arcuate exterior side surface 86, a generally arcuate interior side surface 88 and generally flat opposite end surfaces 90, 92. The intersection of the surfaces of the cutter insert 80 are preferably rounded off.

Cutter insert 80 is positioned within the channel 42 of the cutter bit 10 in a fashion like that for cutter insert 50. The presence of the gaps and positioning of the cutter inserts 80 in a spaced-apart relationship is same as that for cutter insert 50.

While other hard materials may be acceptable, the preferred grade of cemented tungsten carbide for the cutter inserts 50 and 80 is a composition comprising about 90.5 weight percent large grain tungsten carbide and about 9.5 weight percent cobalt.

While other braze alloys may be acceptable, the preferred braze alloy for the cutter bit 10 is a silverbased braze alloy having the following composition: about 50 weight percent silver, about 20 weight percent copper, about 28 weight percent zinc, and about 2 weight percent nickel. The preferred braze alloy has a solidus of about 1220° C. and a liquidus of about 1305° C. This braze alloy is known by the American Welding Society (A5.8) specification BAg-4 A-50N. This preferred braze alloy is sold by Handy & Harman as Braze 505.

All patents and documents referred to by this patent application are hereby incorporated by reference herein.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A rotatable cutter bit that is rotatable about its central longitudinal axis, the cutter bit comprising:

a bit body having opposite forward and rearward ends, the bit body containing a concavity in the forward end thereof wherein the concavity is symmetric about the central longitudinal axis, the concavity having an open end;

a plurality of cutter inserts being secured by brazing to the bit body at the periphery of the open end of the concavity; and adjacent cutter inserts being spaced-apart so that a gap therebetween is sufficient in size to prevent the formation of a continuous braze joint between the adjacent cutter inserts.

2. The rotatable cutter bit of claim 1 wherein the bit body contains a channel about the entire periphery of the open end of the concavity, the channel defining a longitudinal surface and a transverse surface, and each cutter insert forming a braze joint with the longitudinal surface and the transverse surface.

3. The rotatable cutter bit of claim 1 wherein each one of the cutter inserts is made of cobalt cemented tungsten carbide, and the bit body is made from steel.

4. The rotatable cutter bit of claim 3 wherein the cemented tungsten carbide comprises about 90.5 weight percent tungsten carbide and about 9.5 weight percent cobalt.

5. The rotatable cutter bit of claim 1 wherein the braze alloy comprises about 50 weight percent silver, about 20 weight percent copper, about 28 weight percent zinc, and about 2 weight percent nickel.

6. The rotatable cutter bit of claim 1 wherein the bit body having a generally cylindrical shank near the rearward end thereof, the shank containing a groove therein, and a retainer being carried in the groove in the shank.

7. A cutter bit-block assembly comprising:

a block containing a bore therein;

a cutter bit having a bit body with opposite axially forward and rearward ends, the bit body having a central longitudinal axis, the axially forward end of the bit body containing therein a concavity with an open end, the concavity is symmetric about the central longitudinal axis, the bit body having a peripheral surface completely surrounding the open end;

the bit body having a retainer that engages the bore of the block so as to retain the cutter bit to the block so that the cutter bit is rotatable about its longitudinal axis; and a plurality of cutter inserts secured to the peripheral surface in a spaced-apart fashion so that a gap exists between each adjacent one of the cutter inserts, each one of the gaps is sufficient in size to prevent the formation of a continuous braze joint between the adjacent cutter inserts.

8. The cutter bit-block assembly of claim 7 wherein the bit body contains a channel at the periphery of the open end of the concavity, the channel defining a longitudinal surface and a transverse surface, and each cutter insert forming a braze joint with the longitudinal surface and the transverse surface.

9. The cutter bit-block assembly of claim 8 wherein each cutter insert having a top surface, a bottom surface, an external side surface, an internal side surface, and opposite end surfaces, each cutter insert being secured in the channel so that the end surfaces of each one of said cutter inserts does not contact the end surfaces of either one of the two adjacent said cutter inserts; and the bottom surface of each cutter insert forming a braze joint with the transverse surface of the channel and the internal side surface of each cutter insert forming a braze joint with the longitudinal surface of the channel.

10. The cutter bit-block assembly of claim 7 wherein cutter bit is rotatable with respect to the block.

11. A rotatable cutter bit for impinging a substrate, the cutter bit comprising:

an elongate bit body having a central longitudinal axis, the bit body having an impingement end, the impingement end having a peripheral region generally symmetric about the central longitudinal axis, a plurality of cutter inserts connected to the bit body at the peripheral region thereof, the cutter inserts being spaced-apart so as to define a spatial gap between any two adjacent cutter inserts.

12. The cutter bit of claim 11 wherein the bit body contains a cavity at the impingement end thereof, and the cavity has an open end defined by the peripheral region.

13. The cutter bit of claim 12 wherein the cavity is concave in shape.

14. The cutter bit of claim 4 wherein the peripheral region includes a transverse surface generally perpendicular to the longitudinal axis of the bit body, and the cutter inserts being connected to the transverse surface.

15. The cutter bit of claim 14 wherein the cutter inserts being connected to the transverse surface by brazing, and a spatial gap existing between each adjacent cutter inserts that is sufficiently large so as to prevent the formation of a continuous braze joint between the adjacent cutter inserts.

16. The cutter bit of claim 14 wherein the peripheral region further includes a longitudinal surface generally parallel to the longitudinal axis of the bit body, and the cutter inserts being connected to the longitudinal surface.

17. The cutter bit of claim 16 wherein the cutter inserts being connected to the longitudinal surface by brazing, and a spatial gap existing between each adjacent cutter inserts that is sufficiently large so as to prevent the formation of a continuous braze joint between the adjacent cutter inserts.

18. A rotatable cutter bit comprising:

a bit body having opposite forward and rearward ends, the bit body containing a concavity in the forward end thereof, the concavity having an open end;

a plurality of cutter inserts being secured by brazing to the bit body at the periphery of the open end of the concavity;

adjacent cutter inserts being spaced-apart so that a gap therebetween is sufficient in size to prevent the formation of a continuous braze joint between the adjacent cutter inserts;

the bit body contains a channel at the periphery of the open end of the concavity, the channel defining a longitudinal surface and a transverse surface, and each cutter insert forming a braze joint with the longitudinal surface and the transverse surface;

each cutter insert having a top surface, a bottom surface, an external side surface, an internal side surface, and opposite end surfaces, each cutter insert being secured in the channel so that the end surfaces of each one of said cutter inserts does not contact the end surfaces of either one of the two adjacent said cutter inserts; and the bottom surface of each cutter insert forming a braze joint with the transverse surface of the channel and the internal side surface of each cutter insert forming a braze joint with the longitudinal surface of the channel.

19. The rotatable cutter bit of claim 1 comprising seven of the cutter inserts, and each of the cutter inserts being generally arcuate in shape.

20. The rotatable cutter bit of claim 19 wherein each one of the cutter inserts has an included angle of about 44 degrees 30 minutes.

* * * * *

UNITED STATES PATENT AND TRADEMARK OFFICE

CERTIFICATE OF CORRECTION

PATENT NO. : 5,456,522

DATED : October 10, 1995

INVENTOR(S) : Wayne H. Beach

It is certified that error appears in the above-identified patent and that said Letters Patent is hereby corrected as shown below:

Cover page at Item [22], the filing date should be -- October 14, 1994--.

Signed and Sealed this

Fifteenth Day of October, 1996

*Attest:*

Bruce Lehman

BRUCE LEHMAN

*Attesting Officer*

*Commissioner of Patents and Trademarks*